United States Patent [19]

Hirai

[11] Patent Number: 4,918,865

[45] Date of Patent: Apr. 24, 1990

[54] WINDOW OPENER

[75] Inventor: Shoichi Hirai, Nishinomiya, Japan

[73] Assignee: Nippon Cable System Inc., Takarazuka, Japan

[21] Appl. No.: 364,503

[22] Filed: Jun. 8, 1989

Related U.S. Application Data

[63] Continuation of Ser. No. 151,669, Feb. 2, 1988.

[30] Foreign Application Priority Data

Feb. 7, 1987 [JP] Japan ..... 62-26926

[51] Int. Cl.[5] ..... E05F 11/04

[52] U.S. Cl. ..... 49/347; 49/357; 403/383

[58] Field of Search ..... 49/324, 338, 347, 352, 49/354, 357; 403/359, 383; 74/501.5 R, 505, 506

[56] References Cited

U.S. PATENT DOCUMENTS 4,168,594 9/1979 Tuchiya et al. .
4,186,524 2/1980 Pelchat .
4,249,771 2/1981 Gergoe et al. .
4,593,570 6/1986 Niskin ..... 403/383

FOREIGN PATENT DOCUMENTS 19385 of 1911 United Kingdom ..... 49/357

*Primary Examiner*—Kenneth J. Dorner
*Assistant Examiner*—Gerald A. Anderson
*Attorney, Agent, or Firm*—Armstrong, Nikaido, Marmelstein, Kubovcik & Murray

[57] ABSTRACT

A window opener for a remote open-and-close operation of a quater window of an automobile or the like comprises an actuating device, a driving device and pull-cables as a power transmitting member so that freedom of cable-arrangement is widened and large cabin space is remained in an automobile. The actuating device has a pulley, a rotary shaft connected to the pulley, and a link mechanism for converting a rotational torque of the rotary shaft into an opening-and-closing force for a wing member of a window. The pull cables are connected with the pulley so that reciprocal pull-operation through the driving device causes reciprocal rotation of the pulley.

8 Claims, 7 Drawing Sheets

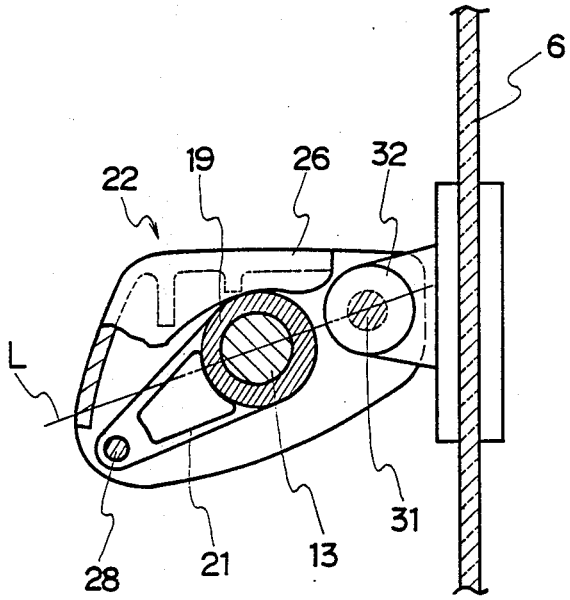
FIG. 4
FIG. 5
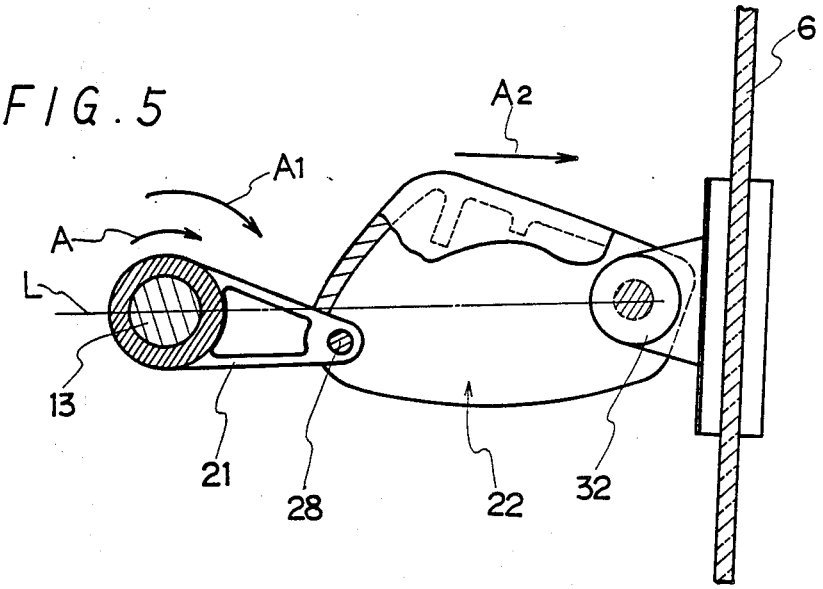

WINDOW OPENER

This application is a continuation of application Ser. No. 151,669 filed Feb. 2, 1988.

BACKGROUND OF THE INVENTION

The present invention relates to a window opener, and more particularly, to a window opener for a remote open-and-close operation of a rear window (a quater window) of a two-door sedan or the like.

There has hitherto been known a window opener disclosed in Japanese Unexamined Utility Model Publication No. 42252/1984.

As shown in FIG. 9, the known window opener comprises a push-pull cable 51 and a rigid arc-shaped rod 52 having an end connected to the cable and another end connected to a window glass pane 53. The rigid rod 52 is slidably moved through a guide pipe 54 curved in the same curvature as that of the rigid rod 52. The cable 51 is pushed and pulled by means of a manual or powered driving device. For example, there is known a manual device shown in FIG. 10 comprising a handle 55, a pinion 56 fixed to the handle 55, a sector gear 57 meshing with the pinion 56 and an arm 58 fixed to the sector gear 57. In the manual device, a rotation of the handle 55 causes a rotation of the pinion 56 and a swing movement of the sector gear 57 to push and pull the cable 51 through the arm 58. The numeral 59 denotes a conduit for guiding the slide movement of the cable 51, and the combined conduit 59 and cable 51 constitute a push-pull control cable for transmitting the push-pull operation from the driving device to the window side. Further, the numerals 60 and 61 denote an inside panel and an outside panel of an automotive body, respectively.

In the conventional window opener, when the cable 51 is pushed, the window glass 53 is also pushed to open, and on the other hand, when the cable 51 is pulled, the window glass 53 is closed.

However, the conventional window opener has a disadvantage that a cabin space becomes narrower since the arc-shaped guide pipe 54 protrudes toward the inside of the cabin.

Further, the push-pull cable 51 which enables the window glass pane 53 to open has a relatively rigid core cable in order to resist a compression force, and therefore, the cable 51 has relatively low flexibility. Accordingly, the freedom or range of choice for design of cable-arrangement is very narrow, since the radius of curvature of the cable cannot be made small when the cable 51 is arranged on the automotive body.

The object of the present invention is to provide a window opener having no projection protruding in the cabin space and having wide range of choice for design of the cable-arrangement.

SUMMARY OF THE INVENTION

According to the present invention, there is provided a window opener for a remote open-and-close operation of a window having a window frame and a wing member rotatably connected to the window frame, comprising a pulley, a rotary shaft engaged with the pulley for co-rotation, a first pull cable connected to the pulley so that a pull-operation of the first pull cable causes a rotation of the rotary shaft in a certain direction, a second pull cable connected to the pulley so that a pull-operation of the second pull cable causes a reciprocating rotation of the rotary shaft in an opposite direction, a driving device for alternation of the pull-operations of the first pull cable and the second pull cable in opposite directions, and a link mechanism for converting a rotational torque of said rotary shaft in a certain direction into a wing-opening force and a rotational torque in the opposite direction into a wing-closing force.

In the window opener of the present invention constructed as mentioned above, when the first pull cable is pull-operated by means of the driving device, the rotary shaft is rotated in a certain direction and the rotational torque is converted into a wing-opening force by means of the link-mechanism. When the second pull cable is pull-operated, the rotary shaft is rotated in the opposite direction, and therefore, the wing member is shut by means of the link-mechanism.

In the present invention, no push-pull cable is used as a power-transmitting means, and only pull-cables are used. Such a pull cable does not require high rigidity, since a pull cable receives only tension force and no compression force is applied to the pull cable. As a result, the pull cable can be constructed into a high soft and flexible form, and therefore, can be arranged in a panel of an automobile or the like in free configurations.

Hereinafter, the window opener of the present invention will be explained on the basis of an example of the window opener applied to a quater window.

BRIEF DESCRIPTION OF THE DRAWINGS

FIGS. 4 and 5 are views illustrating the motion of the link mechanism of FIG. 3 where the wing member is opened and closed, respectively;

DETAILED DESCRIPTION

Figure 1:
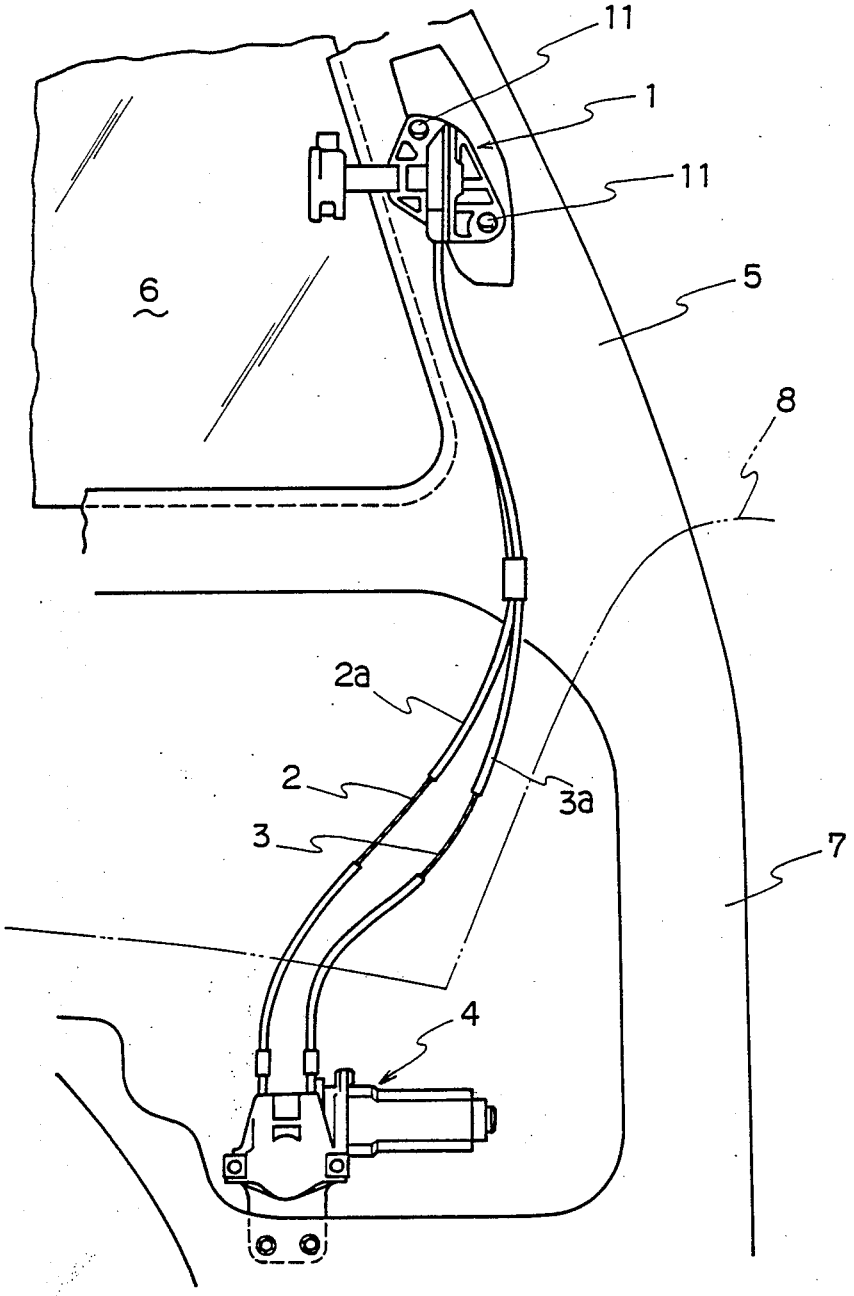
FIG. 1 is a side view showing an embodiment of the window opener of the present invention attached to an automobile.

FIG. 1 shows a side body near a rear seat of a two-door sedan. In FIG. 1, the numeral 5 denotes a window frame, the numeral 6 denotes a window glass pane which is a wing member, the numeral 7 denotes a body-panel provided at a lower side of the window frame 5 and the numeral 8 denotes a rear seat. Though the window glass pane 6 is partially shown (a free end side only) in the drawing, the window glass pane 6 has another hinged side which is rotatably attached to the window frame 5 so that the window glass pane 6 can be operated to open and close in the directions perpendicular with the paper surface.

In the same drawing, the numeral 1 denotes an actuating device, the numeral 2 denotes a first pull-cable (hereinafter, referred to as "first cable"), the numeral 3 denotes a second pull-cable (hereinafter, referred to as "second cable") and the numeral 4 denotes a driving device. The embodiment of the window opener of the present invention comprises the above-mentioned members.

The actuating device 1 is fixed on the window frame 5 by means of bolts 11, and the detail thereof is described later.

The first cable 2 and the second cable 3 are inner cables of pull-control cables (Bowden cables) effecting only for pull-operation. Each cable is, for instance, made of intertwisted steel wires and has a diameter of 1.2 to 1.5 mm. Such a cable is softer and more flexible than a push-pull cable having a large diameter and generally including an inner core or the like. The first cable 2 and the second cable 3 are inserted through conduits 2*a* and 3*a*, respectively. Both ends of each conduit 2*a*, 3*a* are connected to the actuating device 1 and the driving device 4, and the middle portions thereof are laid through pertinent portions of the automotive body.

The driving device 4 comprises an electric motor, a cable-winding drum, and the like. The drum can be rotated in both directions by operating a remotely positioned switch or switches. The first cable 2 and the second cable 3 are connected to the cable-winding drum, so that when the drum rotates in a certain direction, the first cable 2 is wound on the drum and the second cable 3 is rewound from the drum, and on the other hand, when the drum rotates in the reverse direction, the first cable 2 is rewound and the second cable 3 is wound. The driving device 4 is fixed on a pertinent position of the panel 7 by means of bolts or the like.

Hereinafter, referring to FIG. 2, the actuating device 1 is explained in detail.

In a casing 12 comprising a body 12*a* and a cover 12*b*, a rotary shaft 13 is inserted for rotational movement. A pulley 14 is fixed on an end portion of the rotary shaft 13. The pulley 14 has a groove 15 for guiding the cables so that the first and the second cables 2 and 3 are wound in opposite directions, at the peripheral surface of the pulley 14, and has two hollow portions 16 and 17 (see FIG. 6) which are communicated with the groove 15 at both ends of the groove 15. In the hollow portion 16, a nipple 2*b* fixed to an end of the first cable 2 is housed, and the end portion of the first cable 2 is wound around the pulley 14 for a little turns. In the hollow portion 17, another nipple 3*b* fixed to an end of the second cable 3 is housed, and the end portion of the second cable 3 is connected to the pulley 14 for a little turns in the opposite direction. Therefore, there is obtained a system that when the first cable 2 is pulled from the driving device side, the rotary shaft 13 is rotated in a certain direction (shown by arrow A), and while when the second cable 3 is pulled, the rotary shaft 13 is rotated in the opposite direction (shown by arrow B).

The rotary shaft 13 extends toward the left side in the drawing, and at the periphery of the free end of the rotary shaft 13, a serration 18 for securely connecting a link mechanism 20 is formed. Further, a boss 19 of a first link 21 of the link mechanism 20 is mounted on the rotary shaft 13.

Hereinafter, referring to FIG. 3, the link mechanism 20 is explained. The link mechanism 20 comprises a first link 21 and a second link 22. The first link 21 has a base end provided with a through hole 23 and a free end provided with a pin-joint-hole 24. The inner peripheral surface of the hole 23 has a serracted portion which receives the serration 18 of the rotary shaft 13. Further, the first link 21 has a long boss 19 as mentioned above.

The second link 22 comprises a main plate 25 and a rib 26 projecting in a lateral direction. The rib 26 has an L-shaped form and an L-shaped cross section and performs as a reinforcement member and a stopper. The second link 22 has an end 22*a* having a clevice-like-form provided with a pin-joint hole 27. By aligning this pin-joint-hole 27 with the above-mentioned pin-joint hole 24 of the first link 21 and then inserting a pin 28 through the holes 27 and 24, the first link 21 and the second link 22 are rotatably jointed to each other. The second link 22 is provided with a ball joint 31 at a free end thereof, and the ball joint 31 is pivotably inserted into a socket of an attaching bracket 32 fixed to the window glass pane 6.

Since the link mechanism 20 is constructed as mentioned above, when the rotary shaft 13 rotates in the direction of arrow A, the first link 21 also rotates in the direction of arrow A1 and the second link 22 is pushed to extend. Further, when the rotary shaft 13 rotates in the direction of arrow B, the first link 21 rotates in the direction opposite to that mentioned above and the second link 22 is pulled to be folded.

Figure 2:
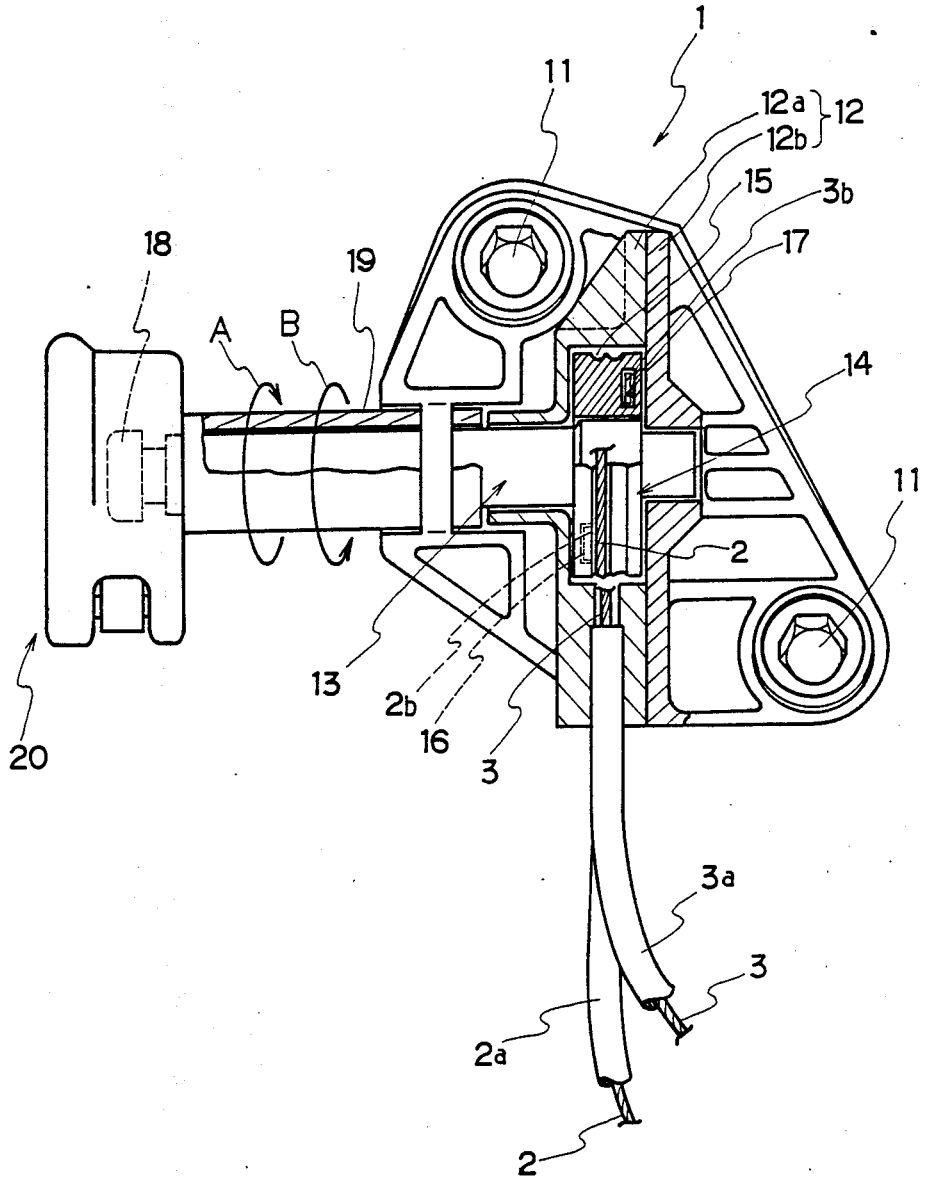
FIG. 2 is a partially cutaway front view showing an embodiment cf an actuating device in the window opener of invention.
Figure 3:
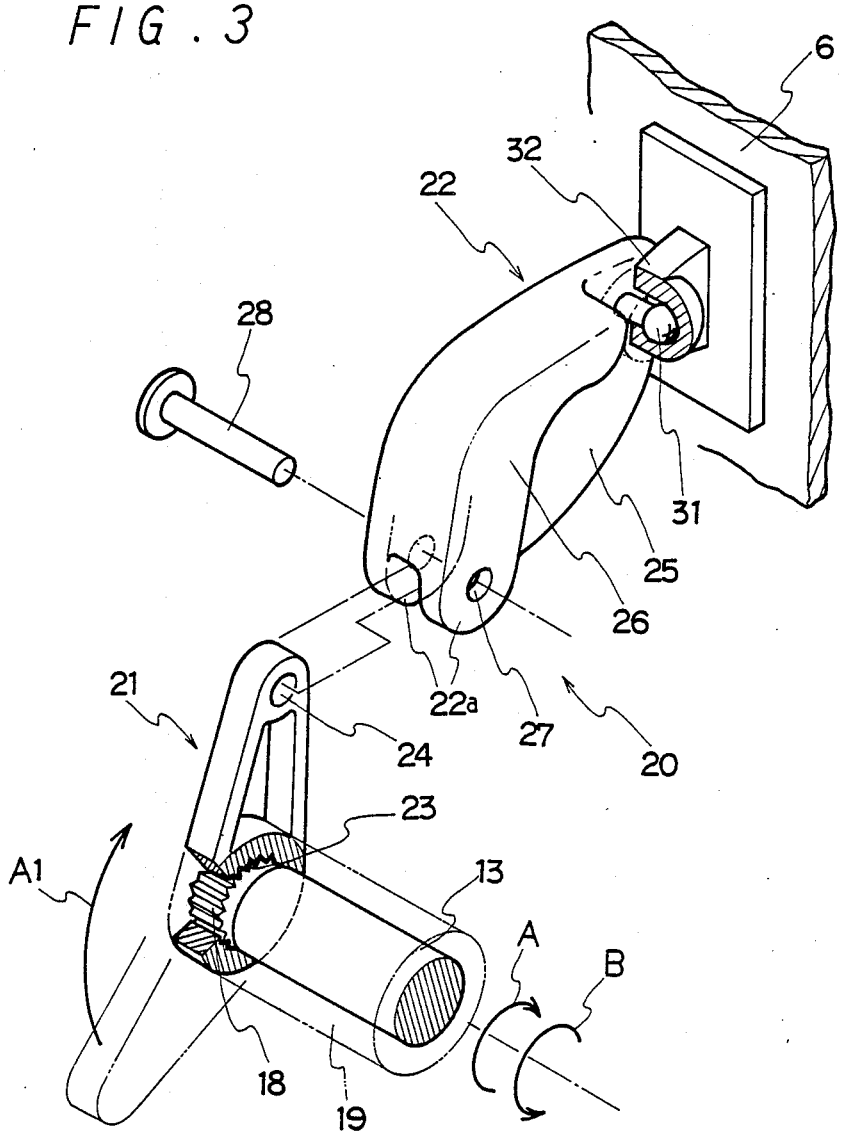
FIG. 3 is a perspective view of a link mechanism of the actuating device shown in FIG. 2.

Next, function of the embodiment of the window opener shown in FIGS. 1 to 3 is explained.

FIG. 4 shows a window glass pane 6 which is in a closed state. In the state, the first link 21 cannot further rotate since the boss 19 of the first link 21 abuts against the rib 26 of the second link 22.

In addition, the pin 28 which is a pivot axis between the first link 21 and the second link 22 is positioned at a lower side than the straight line L joining the center of the rotary shaft 13 and the center of the ball joint 31.

Therefore, even if the window glass pane 6 is directly pushed or pulled toward the open-side by a hand or the like, the links 21 and 22 do not rotate and the window glass pane 6 cannot be opened. Further, since a geared-motor having a worm-gear or the like is employed in the driving device 4 of FIG. 1, the window cannot be directly operated from the window-side.

If an operator intends to open the window glass pane 6, he can open it by pulling the first cable 2 by means of the driving device 4. Then, as shown in FIG. 5, the driving shaft 13 rotates in the direction of arrow A, the first link 21 is rotated in the direction of arrow A1 to push the second link 22 in the direction of arrow A2. Therefore, the free end of the window glass pane 6 is moved toward the right hand side in the drawing, and the window is opened. Under the situation, the rotation of the first link 21 can be stopped by abutting the free end portion of the first link 21 against an end surface of the rib 26 of the second link 22. Further, since the pin 28 is situated at a lower side than the straight line L, a locking function can be obtained.

On the contrary, in case that the operator intends to close the window, he should operate the second cable 3 to pull by means of the driving device 4. Then, the first link 21 rotates in a direction opposite to the direction shown by the arrow Al and pulls the second link 22, and therefore, the window glass pane 6 is shut to the closed position. Then, as shown in FIG. 4, closing operation of the window is completed.

In the embodiment of the actuating device shown in FIGS. 1 to 5, a stopper mechanism which limits the range of the open-close motion of the window is provided. However, if another stopper mechanism which can directly limit the rotation of the pulley 14, is additionally provided in the actuating device, there can be obtained further advantageous function.

Figure 6:
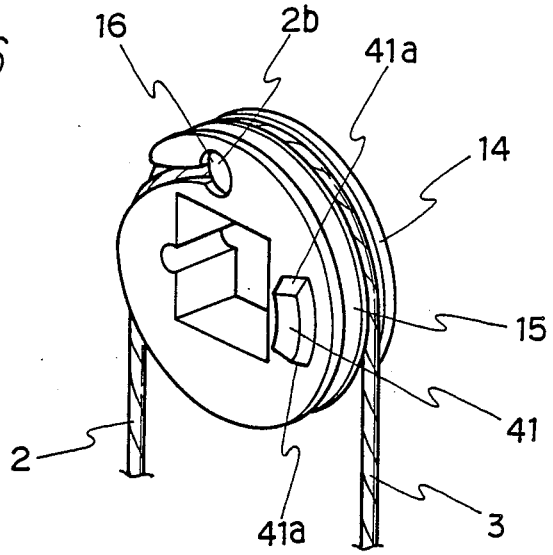
FIGS. 6 and 7 are perspective views showing another embodiments of a pulley and a cover of a casing, respectively, in the present invention.
Figure 7:
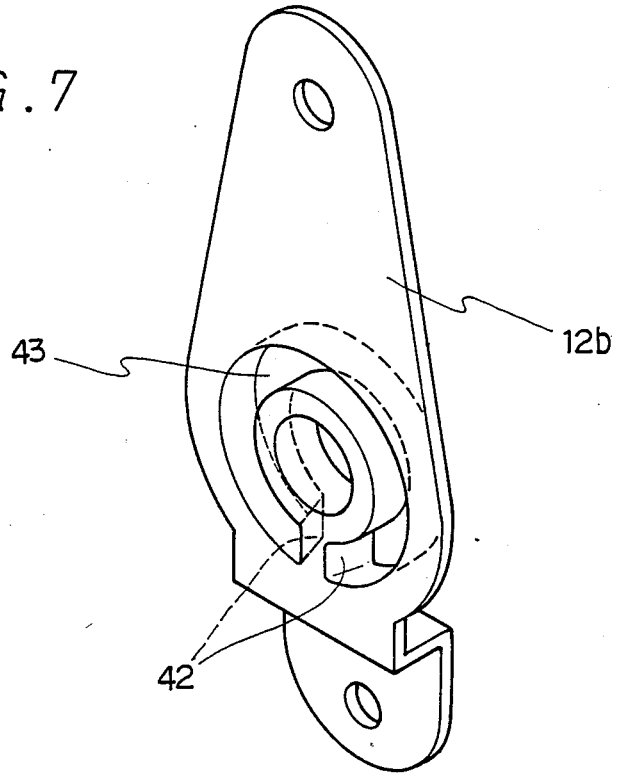

FIGS. 6 and 7 show an example of the above-mentioned preferable stopper mechanism acting between a pulley 14 and a casing 12. Namely, the pulley 14 shown in FIG. 6 has a surface adjacent to a cover 12*b* of the casing 12, which is provided with an arc-shaped projection 41, and the cover 12*b* is provided with an almost-annular groove 43 capable of housing the projection 41 so that the projection 41 can freely moves along the groove 43 as shown in FIG. 7. A slantingly standing wall 42 is provided at a middle position of the almost-annular groove 43. The wall 42 determines the ends of the groove 43 and provides portions against which the end surfaces 41*a* of the projection 4 abut to stop the rotation of the pulley 14. That is to say, the projection 41 and the groove 43 with the wall 42 construct a stopper mechanism for directly limiting the rotation angle of the pulley 14, and therefore, the rotation angle of the pulley 14 is limited to a range between positions where the end surfaces 41*a* of the projection 41 abut against the slant walls 42. Such construction can be employed since the rotational angle of the pulley 14 is almost 200° which is less than one rotation (360°).

Advantages of the stopper mechanism are explained hereinafter.

Figure 7A:
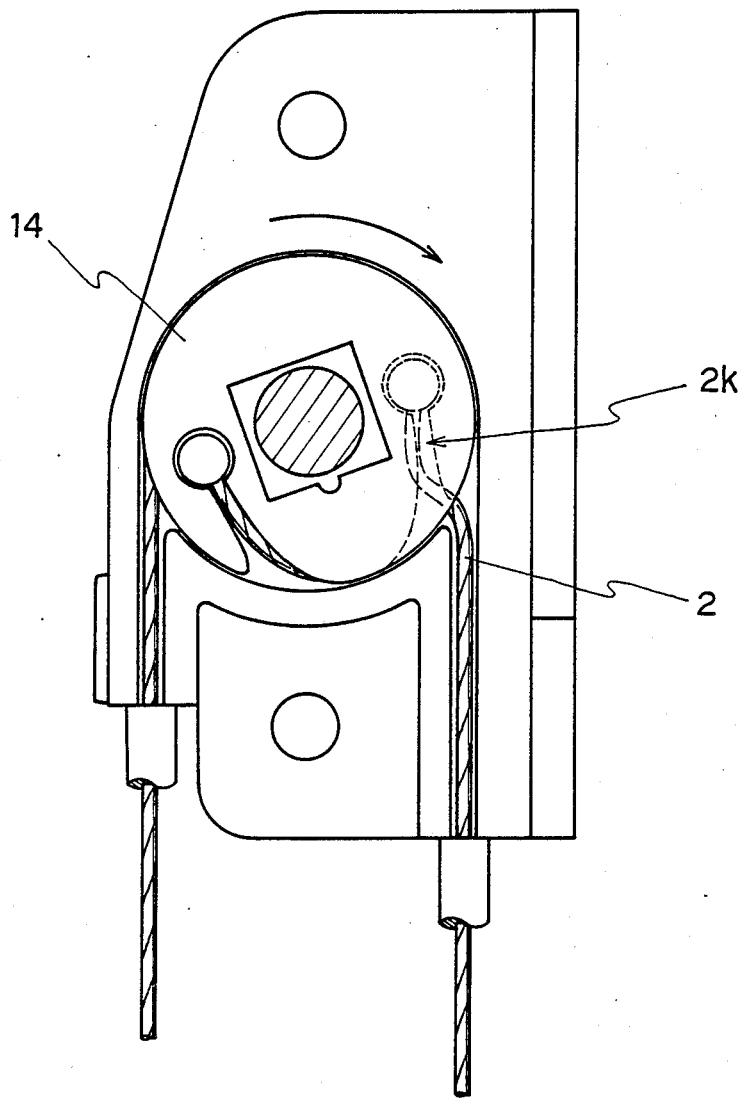
FIG. 7A is a front view showing an embodiment of a pulley having no stopper in the present invention.

If the pulley 14 excessively rotates relative to the link mechanism, almost a whole length of the cable is unwound from the pulley 14, and therefore, slack originally existing in the cables 2 and 3 generates a kink 2*k* shown in FIG. 7A. However, in the device of FIGS. 6 and 7, because of the limitation of the rotatable range of the pulley 14, there can be prevented a slack of the cable due to an excess rotation of the electric motor of the driving device or excess rotation of the pulley 14 and a kink 2*k* of the cable 2, and therefore, the cable is always kept in a condition where suitable tension is applied on the cable.

In addition, a slack in the cable provides a probability of cutting of the cable when the cable is operated, since the condition of the cable suddenly changes from no-tension to a high-tension when a cable-pull-operation in the opposite direction starts. However, if the tension of the cable is always kept in a certain level by means of the both-directions-stopper mechanism as mentioned above, the tension of cable gradually changes and the cable can be protected from cutting. Further, though the number of turns of the cable is small, e.g. 1.5 to 2 turns, there can be obtained an advantage that a suitable open-close stroke can be ensured by assembling the pulley 14 with the stopper (the wall 42) as a mark.

In addition, when the mechanism limiting the rotatable range is provided not in the driving device 4 side but in the actuating device 1 side, an impact force applied on the pulley 14 when the pulley 14 is forced to stop can be absorbed by the resilience of the cable itself. Therefore, there can be obtained an advantage that worm gear or the like in the driving device 4 does not directly receive a large impact force in comparison with such case that a stopper mechanism is installed in the driving device in order to stop the rotation of the worm gear or the like. As a result, the worm gear or the like is advantageously prevented from damage.

Figure 8:
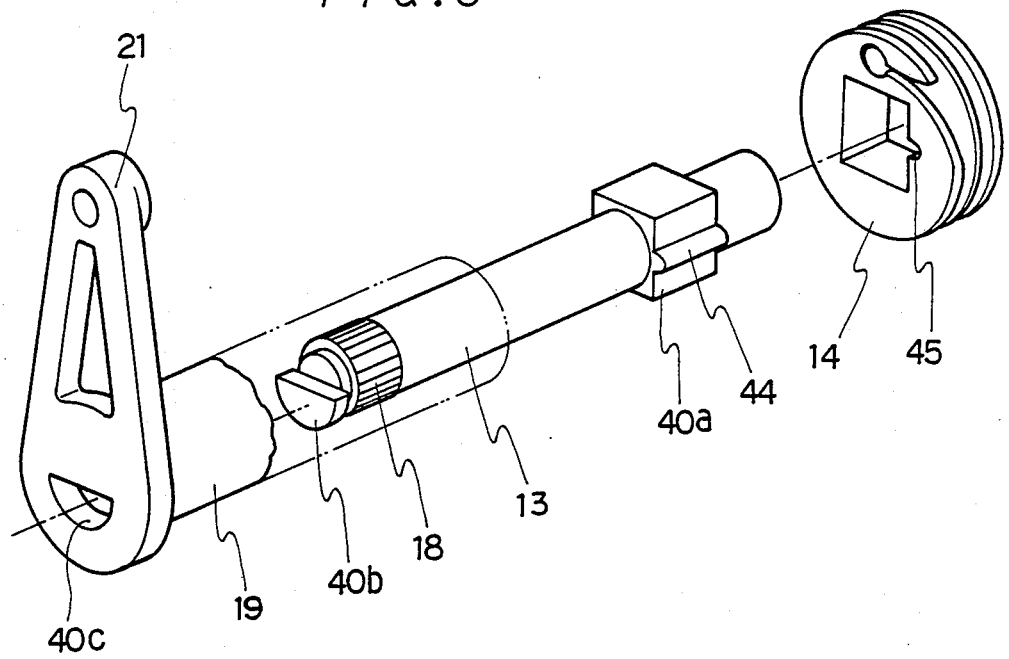
FIG. 8 is a perspective view showing an embodiment of a pulley, a rotary shaft and a first link in the combined state in the present invention.
Figure 9:
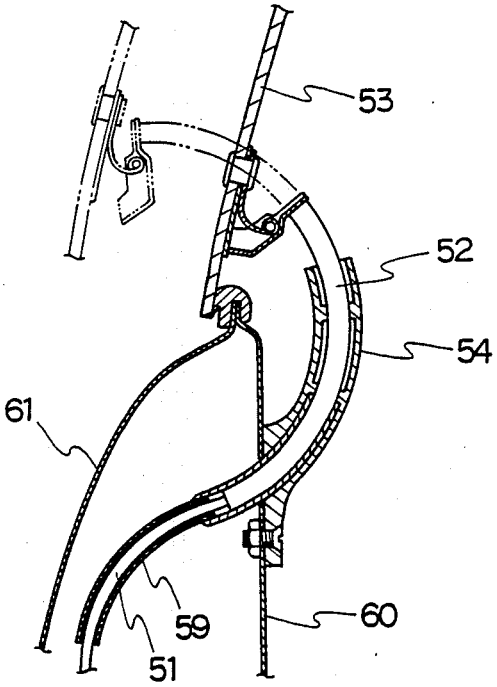
FIG. 9 (PRIOR ART)
FIGS. 9 and 10 are illustrations showing an actuating device and a driving device, respectively, of an example of conventional window regulators.
Figure 10:
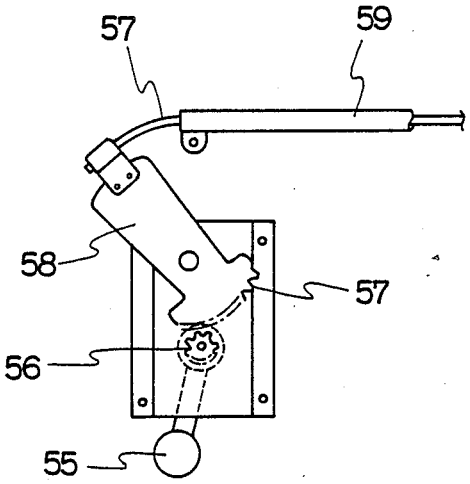
FIG. 10 (PRIOR ART)

Referring to FIG. 8, an example of a combination of a pulley 14 and a first link 21 where the pulley 14 and the first link 21 can always be connected in a correct attaching angle.

In the embodiment shown in FIGS. 2 and 3, the rotary shaft 13 and the pulley 14 have engaging portions each having a common square cross section so as to transmit a torque. Therefore, there is four ways to combine the rotary shaft 13 and the pulley 14.

On the contrary, in the case of FIG. 8, the engaging portion 40*a* having a square cross section is provided with a linear projection 44 extending in the direction of the axis of the rotary shaft 13 on a surface thereof, and the engaging square hole of the pulley 14 is provided with an engaging slot or groove 45 for receiving the projection 44 of the rotary shaft 13. Therefore, the rotary shaft 13 and the pulley 14 can be combined in a particular angle relation alone, i.e. in a condition that the projection 44 meets with the groove 45 alone.

Farther, the engaging portions 40*b* and 40*c* between the rotary shaft 13 and the first link 21 have a common semi-circular cross section as shown in FIG. 8. Therefore, also the rotary shaft 13 and the first link 21 can be combined in a particular angle relation alone.

Accordingly, there can be obtained an advantage that the pulley 14 and the first link 21 are always assembled in an angle relation predetermined when they are designed without any misassemble.

The configuration of the engaging portions are not limited in the above-mentioned shapes, but any configurations can be employed so far as they can be easily manufactured and assembled.

The numeral 18 in FIG. 8 denotes the same serration 18 of FIG. 3, and the serration 18 engages with the serrated portion formed in the inner peripheral surface of a boss 19 fixed on the first link 21.

The pull-cable employed as a power transmitting member in the window opener of the present invention has high flexibility, and therefore, can be easily curved with a small radius of curvature. Therefore, the range of choice for the arrangement of the cables is relatively wide, and arrangement design is easy. In addition, an attaching position of the driving device 4 to the automotive body, can be selected in a relatively free manner without severe limitation.

Further, when the construction in which a pair of pull cables is stretched between a pulley and a drum is employed as mentioned in the embodiments, many advantages e.g. low noize, low cost for production, high durability and high reliability can be obtained.

In the present invention, a switch or switches for operating the window opener can be attached at any position of the automotive body through lead wires. Therefore, the window opener can be operated either from the driver's seat or from the rear seat.

The window opener of the present invention can be applied not only to a quater window of a two-door sedan, but also to various type of windows, e.g. a sunroof or a roof window of an automobile, a window of a building, and the like.

Though several embodiments of the invention are described above, it is to be understood that the present invention is not limited to the above-mentioned embodiments, and various changes and modifications may be made in the invention without departing the spirit and the scope thereof.

I claim:

1. A window opener for open-and-close operation of a window having a window frame and a wing member rotatably connected to said window frame, comprising:

a pulley;

a rotary shaft engaged with said pulley for co-rotation;

a first pull cable wound on said pulley in a first direction so that a pull-operation of said first pull cable causes a rotation of said rotary shaft in a certain direction;

a second pull cable wound on said pulley in a direction opposite to said first direction so that a pull-operation of said second pull cable causes a reciprocating rotation of said rotary shaft in an opposite direction;

a driving device for alternation of pull-operations of said first pull cable and said second pull cable in opposite directions; and a link mechanism for converting a rotational torque of said rotary shaft in both directions into an opening-and-closing force for said wing member.

2. The window opener of claim 1, further comprising a stopper mechanism for limiting a range of rotation of said pulley in both directions; said stopper mechanism being provided between said pulley and a casing adjacent said pulley.

3. The window opener of claim 1, wherein said pulley and a first link of said link mechanism each have an engaging hole therein, said rotary shaft has ends to be inserted in said engaging holes of said pulley and said first link; engaging portions between said rotary shaft and said pulley have such common cross section that said rotary shaft and said pulley are engaged with each other in a predetermined attaching angle; and engaging portions between said rotary shaft and said first link have such common cross section that said rotary shaft and said first link are engaged with each other in a predetermined attaching angle.

4. A window opener for open-and-close operation of a window having a window frame and a wing member rotatably connected to said window frame, comprising:

a pulley;

a rotary shaft engaged with said pulley for co-rotation at an end thereof;

a first pull cable wound on said pulley in a first direction so that a pull-operation of said first pull cable causes a rotation of said rotary shaft in a certain direction;

a second pull cable wound on said pulley in a direction opposite to said first direction so that a pull-operation of said second pull cable causes a reciprocating rotation of said rotary shaft in an opposite direction;

a driving device having an electric motor capable of rotating in both directions for alternation of pull-operations of said first pull cable and said second pull cable in opposite directions; and a link mechanism for converting a rotational torque of said rotary shaft in both directions into an opening-and-closing force for said wing member.

5. The window opener of claim 4, wherein said driving device has an electric motor rotatable in both rotary directions and a cable-winding pulley connected to said electric motor through a reduction gear; said first pull cable is wound on said cable-winding pulley in said first direction so that a first rotation of said driving pulley causes a pull-operation of said first pull-cable; and said second pull cable is wound on said cable-winding pulley in said direction opposite to said first direction of the first pull cable so that a rotation opposite to the first rotation of said cable-winding pulley causes a pull-operation of said second pull-cable.

6. The window opener of claim 5, further comprising a stopper mechanism for limiting a range of rotation of said pulley in both directions; said stopper mechanism being provided between said pulley and a casing adjacent said pulley.

7. The window opener of claim 4, wherein said link mechanism has a first link fixed on another end of said rotary shaft and a second shaft having an end pivotary jointed with free end of said first link and another end pivotary jointed with said window frame; and said first and second links are capable of opening to an angle somewhat larger than 180°.

8. The window opener of claim 7, wherein said pulley and said first link mechanism each have an engaging hole therein, said rotary shaft has ends to be inserted in said engaging holes of said pulley and said first link; engaging portions between said rotary shaft and said pulley have such common cross section that said rotary shaft and said pulley are engaged with each other in a predetermined attaching angle; and engaging portions between said rotary shaft and said first link have such common cross section that said rotary shaft and said first link are engaged with each other in a predetermined attaching angle.

* * * * *